US005376174A

United States Patent [19]

Sommer

[11] Patent Number: 5,376,174

[45] Date of Patent: Dec. 27, 1994

[54] DRIVE ARRANGEMENT FOR A MACHINE FOR APPLICATION OF SEALANT TO LIDS

[75] Inventor: Walter Sommer, Essen, Germany

[73] Assignee: Krupp Maschinentechnik Gesellschaft Mit Beschrankter Haftung, Essen, Germany

[21] Appl. No.: 974,602

[22] Filed: Nov. 12, 1992

[30] Foreign Application Priority Data

Nov. 11, 1991 [DE] Germany ..... 4136981

[51] Int. Cl.[5] ..... B05C 13/00

[52] U.S. Cl. ..... 118/52; 118/318; 118/319; 118/320

[58] Field of Search ..... 118/52, 317, 318, 319, 118/320

[56] References Cited

U.S. PATENT DOCUMENTS

| | | | |
|---|---|---|---|
| 2,185,089 | 12/1939 | Kronquest | 118/52 |
| 4,262,629 | 4/1981 | McConnellogue et al. | 118/668 |
| 4,605,351 | 12/1986 | Hatcher et al. | 413/58 |
| 4,806,197 | 2/1989 | Harvey | 156/449 |
| 4,994,135 | 2/1991 | Orlandi | 156/362 |
| 5,259,913 | 11/1993 | Stover | 156/566 |

FOREIGN PATENT DOCUMENTS

| | | |
|---|---|---|
| 1304457 | 8/1962 | France . |
| 2336982 | 7/1977 | France . |
| 963865 | 12/1962 | United Kingdom . |

OTHER PUBLICATIONS

McKay, *Mechanical Engineers' Handbook*, pp. 10-52-1-0-53, Sixth Edition, 1958.

*Primary Examiner*—Michael W. Ball
*Assistant Examiner*—Paul M. Rivard
*Attorney, Agent, or Firm*—Spencer, Frank & Schneider

[57] ABSTRACT

A drive arrangement for a machine for the application of sealant to lids includes a turret head rotatable about a vertical axis. A main drive motor is coupled for driving the turret head for rotation about the vertical axis. A ring of teeth is mounted for rotation about the vertical axis and relative to the turret head. A plurality of sleeve shafts carries plates for the accommodation of lids. The sleeve shafts are mounted for rotation about axes that are parallel to the vertical axis. Each sleeve shaft includes a pinion that is in engagement with the ring of teeth. An auxiliary drive motor is provided which is independent of the main drive motor. The auxiliary drive motor is connected with the ring of teeth for driving the pinions by way of the ring of teeth at a rate of rotation independent of the rate of rotation of the turret head caused by the main drive motor.

5 Claims, 3 Drawing Sheets

DRIVE ARRANGEMENT FOR A MACHINE FOR APPLICATION OF SEALANT TO LIDS

CROSS REFERENCE TO RELATED APPLICATIONS

The present application claims the rights of priority with respect to application Ser. No. P 41 36 981.5 filed Nov. 11th, 1991, in Germany, the subject matter of which is incorporated herein by reference.

BACKGROUND OF THE INVENTION

The present invention relates to a drive arrangement for a machine for applying sealant to lids that includes a turret head driven by a drive motor to rotate about a vertical axis and equipped with a plurality of sleeve shafts that are provided with plates for holding lids, with the sleeve shafts being mounted for rotation about axes arranged parallel to the vertical axis of the turret head. Each sleeve shaft is provided with a pinion that is in engagement with a ring of teeth that rotates about the vertical axis and relative to the turret head.

A drive for a machine for applying a sealant material into lids is disclosed in U.S. Pat. No. 4,262,629. The lids are delivered to one station of a rotating turret or machine head provided with a plurality of lower sleeve shafts and respective upper resilient counterholders and spray guns with a liquid sealant or rubberizing substance. The sleeve shafts are provided with upper plates and are slidably and rotatably mounted within the machine head. During rotation of the machine head, the sleeve shafts are raised and the plates push the lids against the counterholders. Upon further rotation of the machine head, the sealant is supplied to the inner edge of the lid from the associated spray gun. Due to the rapid rotation of the sleeve shafts and lids, the sealant distributes itself uniformly. In the prior art machines for applying sealant to lids, the ring of teeth with which the pinions of the sleeve shafts are in engagement is driven by way of a number of drive transmission means by the same main motor as the turret head itself. Although the turret head and the revolving ring of teeth rotate at different rates, they are rigidly connected with respect to their drives, that is, their rotational rates are at a constant ratio. If now the turret head stops due to an operational malfunction, the rotating ring of teeth also stops and the sleeve shafts are unable to rotate any further. The sealant or rubberizing substance which is dispensed onto a lid when the turret head is braked or stops, is no longer able to flow properly and an unusable lid results.

Another drawback of the prior art drive arrangement is that if the rate of rotation of the sleeves relative to the turret head is to be changed, for example, if a different size lid is employed (i.e. the lid diameter changes), at least one pair of gears must be exchanged in order to change the transmission ratio.

SUMMARY OF THE INVENTION

It is an object of the present invention to provide a drive for a machine for the application of sealant to lids in which the sleeve shafts responsible for the rotation of the lids continue to rotate when the turret head stops so that the liquid sealant or rubberizing substance is able to continue to flow out.

The above and other objects are accomplished according to the invention by the provision of a drive arrangement for a machine for the application of sealant to lids including: a turret head rotatable about a vertical axis; a main drive motor coupled for driving the turret head for rotation about the vertical axis; a ring of teeth mounted for rotation about the vertical axis and relative to the turret head; a plurality of sleeve shafts carrying plates for the accommodation of lids, with the sleeve shafts being mounted for rotation about axes that are parallel to the vertical axis, each sleeve shaft including a pinion that is in engagement with the ring of teeth; and additionally including an auxiliary drive motor which is independent of the main drive motor and connection means for connecting the auxiliary drive motor with the ring of teeth for driving the pinions by way of the ring of teeth at a rate of rotation independent of the rate of rotation of the turret head caused by the main drive motor.

If the turret head stops, the ring of teeth driving the sleeve shafts is able to continue rotating so that the lids held on the sleeves are also not stopped and the sealant or rubberizing substance is able to flow out. The rotational rate of the sleeve shafts is a function of the rotational rate of the ring of teeth as well as on the rate of rotation of the turret head. However, as will be later shown, the rate of rotation of the turret head can be negated from the equation for determining the rotational rate of the sleeve shafts, thereby making the rate of rotation of the sleeve shafts independent of the rate of rotation of the turret head.

The rotation of the turret head, which is customarily directed opposite to the direction of rotation of the ring of teeth, increases the rotational rate of the sleeve shafts. A feature of the invention provides that the ring of teeth is driven by the auxiliary drive motor so that the rotational rate of the ring of teeth drops with increasing rotational rate of the turret head.

Such a reduction in the rotational rate of the ring of teeth is advantageously accomplished in that the connection between the ring of teeth and the auxiliary drive motor is effected by way of a differential gear which has a rotating housing driven by the auxiliary drive motor. One driven shaft of the differential gear is connected in a torque transmitting manner with the ring of teeth and another driven shaft is connected with the main drive motor.

In a differential gear, half the sum of the rotational rates of the driven shafts equals the rotational rate of the rotating housing. If both driven shafts rotate at the same rate, that rate is equal to that of the housing. If one driven shaft is braked, the rotational rate of the other driven shaft increases correspondingly, with the rate of rotation of the housing remaining constant. A further feature of the invention utilizes this fact. If the rotational rate of the main drive motor, and thus the rotational rate of the turret head which is proportional thereto, is reduced, the rotational rate of the driven shaft of the differential gear connected with the main drive is reduced correspondingly and the rotational rate of the driven shaft connected with the ring of teeth is increased correspondingly. Thus, the drop in the rotational rate of the sleeve shafts caused by the turret head and the main drive is compensated.

In order to keep the rate of rotation of the sleeve shafts constant relative to the turret head independently of the rotational rate of the turret head, it is further proposed that the connection of the one driven shaft of the differential gear with the main drive motor be effected by way of the turret head and that the transmission ratio from this driven shaft to the turret head be the same as the transmission ratio from the other driven shaft of the differential gear to the ring of teeth. Since the regulating influence of the turret head is directed toward the differential gear, the above condition may also be formulated in such a way that the transmission ratio from the turret head to the driven shaft of the differential gear connected therewith is equal to the reciprocal of the transmission ratio from the other driven shaft to the ring of teeth.

To maintain a constant rate of rotation for the sleeve shafts relative to the turret head, the ring of teeth may also be driven by the auxiliary drive motor by way of a fixed transmission ratio if the speed of the auxiliary drive motor is changed by means of an adjustment device as a function of the rotational rate of the turret head.

Additionally, it is also possible to drive the ring of teeth by means of the auxiliary drive motor by way of a transmission having a transmission ratio that can be varied as a function of the rate of rotation of the turret head.

In a sealant applying machine according to the invention, the rotational rate of the turret head and thus the configuration of the machine may be freely selected or predetermined to thus adapt it to the most varied circumstances. This is of interest, for example, if an accumulation path results upstream or downstream of the sealant applying machine or if the configuration of a preceding lid punching press changes. Change of lid diameter also poses no problems since the correct rate of rotation for the sleeve shafts for the respective lid diameter and the respective sealing or rubberizing substance is effected by a change in the rotational rate of the auxiliary drive motor.

Embodiments of the invention are schematically illustrated in the drawings and will now be described in greater detail.

DESCRIPTION OF PREFERRED EMBODIMENTS

Figure 1:
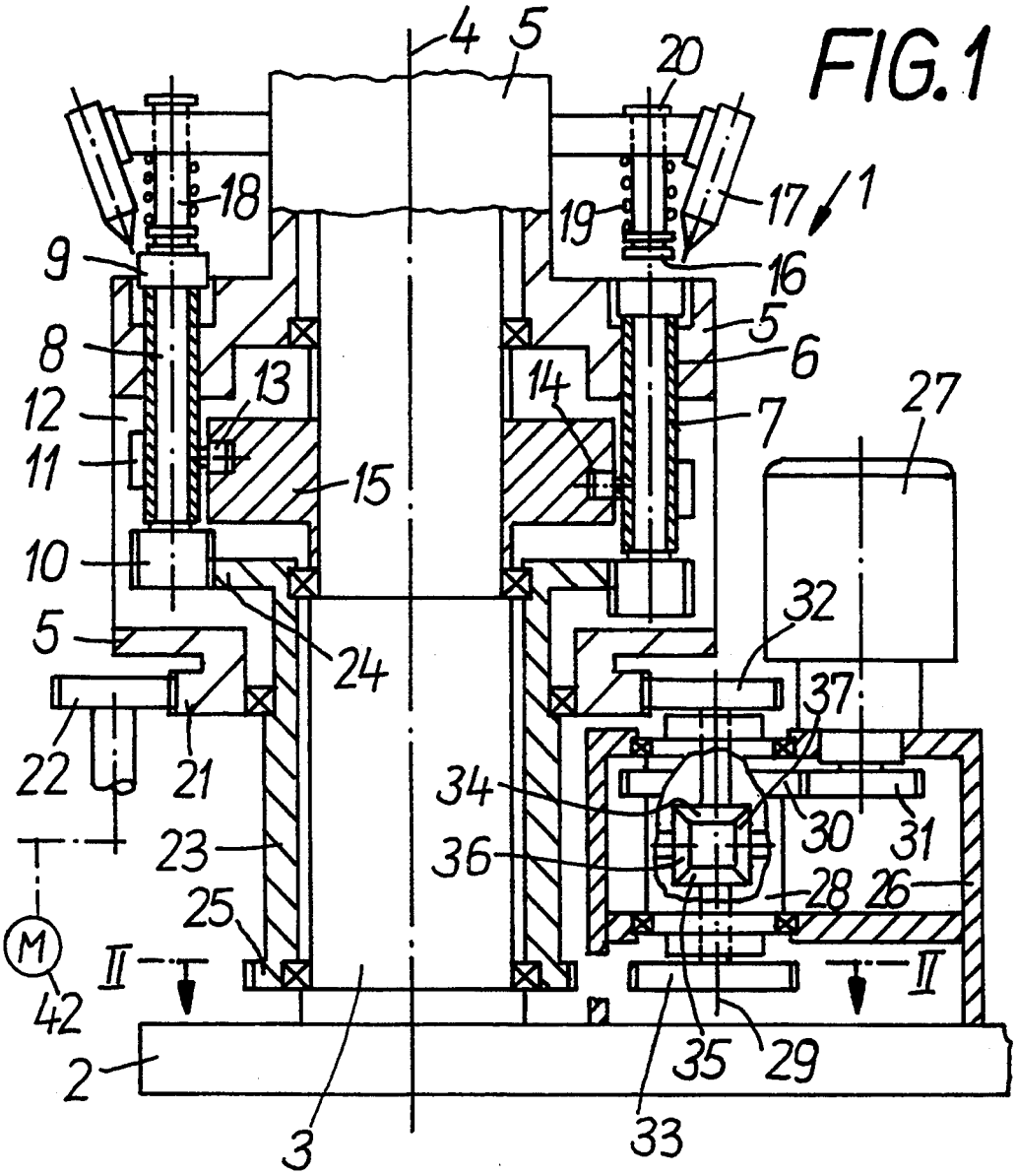
FIG. 1 is a vertical longitudinal sectional view of a sealant applying machine.

Referring to FIG. 1, there is shown a sealant applying machine 1 which includes a central column 3 fixed to a machine frame 2 and having a vertical axis 4. A turret head 5 has a plurality of passage bores 6 arranged parallel to axis 4 and is rotatably mounted on column 3. Sleeves or bearing sleeves 7 are guided in passage bores 6 to slide axially, and sleeve shafts 8 are rotatably mounted within the sleeves 7. At their tops, sleeve shafts 8 each have a plate 9 suitable to receive a can lid (not shown) and at their bottoms have a gear or pinion 10. Plate 9 as well as pinion 10 are fixed to shaft sleeve 8.

On its side facing away from vertical axis 4, each bearing sleeve 7 is provided with a guide element 11 that is guided in a guide groove 12 of turret head 5 and prevents rotation of the sleeve relative to the turret head. On its side facing vertical axis 4, each sleeve 7 is provided with a roller 13 which runs in a cam track 14. Cam track 14 is cut into the circumference of a body of rotation 15 that is connected with column 3, for example by means of a wedge connection (not shown) to be secure against rotation. Cam track 14 causes sleeve 7 to move axially along with sleeve shaft 8, plate 9 and pinion 10.

Above each plate 9, a counterholder 16 and a spray gun 17 are disposed on rotatable turret head 5. Counterholder 16 is rotatably mounted at the lower end of an axially movable pin 18. Pin 18 is urged downward by a spring 19. A rearward stop 20 determines the lowermost position of counterholder 16.

At its lower end, turret head 5 is provided with a ring of teeth 21 which meshes with a toothed wheel 22 that is driven by a main motor 42.

Within turret head 5, a drive sleeve 23 is rotatably mounted to column 3, with the lower end of turret head 5 in turn being seated on drive sleeve 23. Drive sleeve 23 is provided with a ring of teeth 24 at its top and a ring of teeth 25 at its bottom. The pinions 10 of sleeve shafts 8 are in engagement with the upper ring of teeth 24. In order for pinions 10 to remain reliably in engagement with ring of teeth 24 even during the axial stroke caused by cam track 14, pinions 10 are given a corresponding height and width, respectively.

An auxiliary motor 27 and a differential gear 28 are mounted on an auxiliary frame 26 of machine frame 2. Auxiliary motor 27 has a drive pinion 31 and is independent of main drive motor 42 of the sealant applying machine. Differential gear 28 has a housing that is rotatable about a vertical axis 29. A ring of teeth 30 is fixed to the differential gear housing and is in engagement with drive pinion 31 of auxiliary motor 27. Differential gear 28 is provided with two driven pinions 32 (top) and 33 (bottom) coaxial with axis 29. Driven pinions 32 and 33 are connected in a known manner within the differential gear housing to rotate together with bevel gears 34, 35 which are in engagement with one another by way of compensating gears 36, 37 that are mounted in the housing.

Figure 2:
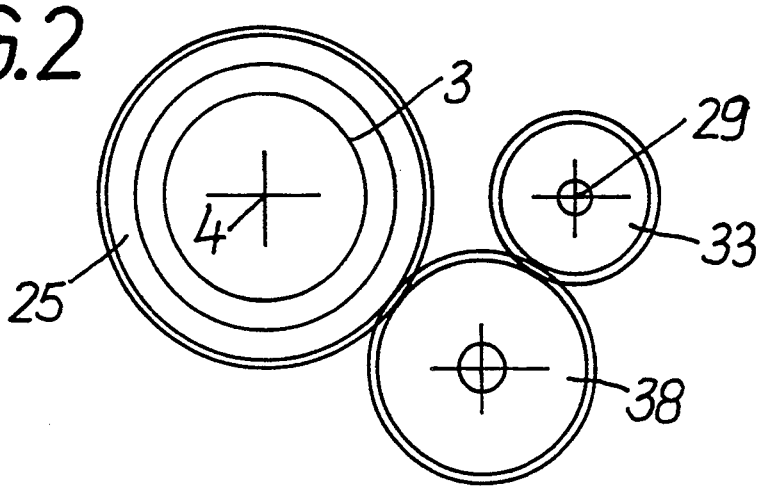
FIG. 2 is a partial horizontal cross-sectional view seen along line II—II of the sealant applying machine shown in FIG. 1.

Upper driven pinion 32 is in engagement with ring of teeth 21 of turret head 5 as is gear 22 that is driven by the main drive motor 42. Lower driven pinion 33 is in engagement with lower ring of teeth 25 of drive sleeve 23 by way of an intermediate gear 38 shown in FIG. 2.

The rate of rotation $n_K$ of the turret head 5 which corresponds to the configuration of the sealant applying machine is determined exclusively and directly by the rate of rotation of main drive gear 22.

The rate of rotation $n_{P/K}$ of sleeve shafts 8 and plates 9 that are fixed to them about the axis of the sleeve shafts with reference to turret head 5 is determined independently of the rate of rotation $n_K$ of turret head 5 exclusively by the rate of rotation $n_{27}$ of auxiliary motor 27.

This will now be explained with reference to a concrete numerical example which is based on the following numbers of gear teeth:

pinion 31: 53 ring of teeth 30: 77 driven pinion 32: 30
ring of teeth 21: 120
driven pinion 33: 40
ring of teeth 25: 160
ring of teeth 24: 146
pinion 10: 34

Figure 3:
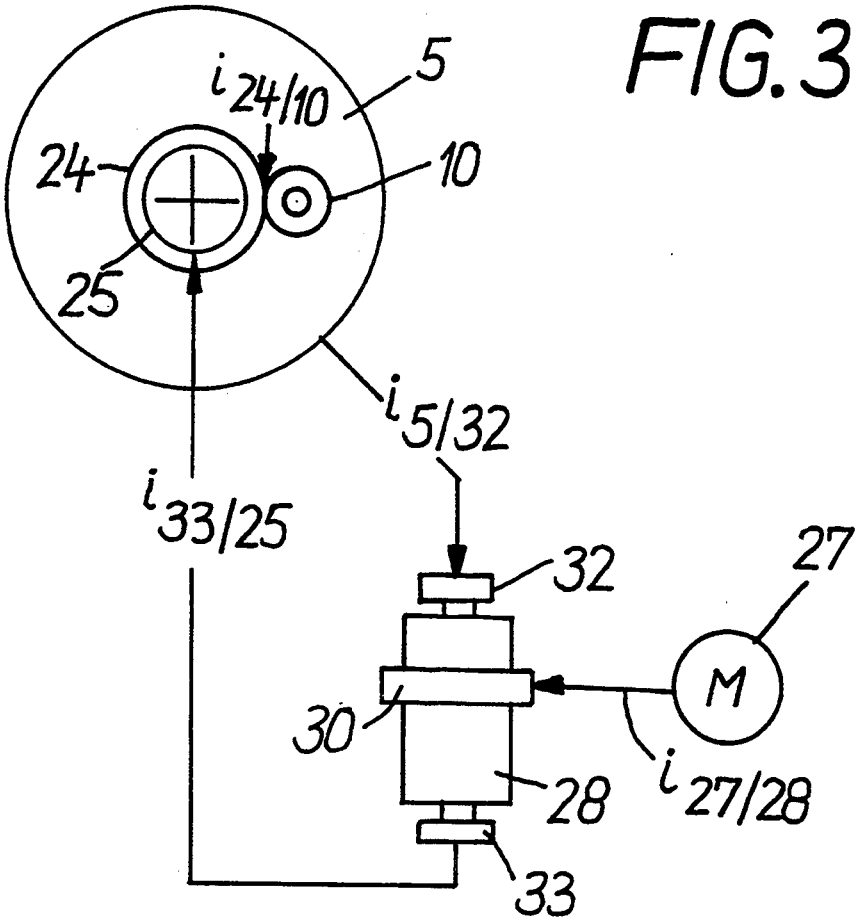
FIG. 3 is a schematic illustration of the driving linkage of the sleeve shafts, turret head and auxiliary drive motor.

For the transmission ratios identified in FIG. 3 these tooth numbers provide the following values (the respective indices correspond to the reference numerals of the respective components):

transmission ratio between auxiliary motor 27 and toothed wheel 30 of differential gear 28:
$i_{27/28}=53/77$;

transmission ratio from the driven shaft of the differential gear 28 with its pinion 33 to the drive sleeve 23 and ring of teeth 25, respectively:
$i_{33/25}=40/160=\frac{1}{4}$;

transmission ratio from ring of teeth 24 to sleeve pinions 10:
$i_{24/10}=146/34$;

transmission ratio from turret head 5 by way of ring of teeth 21 to the driven shaft of differential gear 28 and pinion 32:
$i_{5/32}=120/30=4/1$.

It is also assumed that the rate of rotation $n_{27}$ of auxiliary drive motor 27 and its drive pinion 31 is 1400 $\text{min}^{-1}$.

The rate of rotation $n_{P/K}$ of sleeve shafts 8 and pinions 10, in reference to turret head 5, as a function of the rate of rotation $n_{24}$ of ring of teeth 24 and the rate of rotation $n_K$ of turret head 5 which rotates in the opposite sense is the following:

$$n_{P/K}=i_{24/10}(n_{24}+n_K)$$

If one considers that the rate of rotation of the pinion 33 of differential gear 28 is the following:

$$n_{33}=2\,n_{28}-n_{32},$$

where $$n_{32}=n_K\,i_{5/32}$$

the following results when using this equation and converting it for the rate of rotation $n_{P/K}$ of sleeve shafts 8:

$$n_{P/K}=[2\,n_{27}\cdot i_{27/28}\cdot i_{33/25}+n_K(1-i_{5/32}\cdot i_{33/25})]i_{24/10}$$

Since the transmission ratio $i_{5/32}$ at 4/1 is inversely proportional to the transmission ratio $i_{33/25}$ of 1/4, the value zero results for the factor of the rate of rotation $n_K$ regardless of the magnitude of transmission ratio $i_{24/10}$, that is, the rate of rotation $n_K$ of turret head 5 is not included at all in the respective rates of rotation $n_{P/K}$ of sleeve shafts 8. For the rate of rotation $n_{27}$ of auxiliary drive motor 27 on which the numerical example is based, there thus results a constant rate of rotation for sleeve shafts 8 that is completely independent of turret head 5 as follows:

$$n_{P/K}=2\cdot1400\cdot77/53\cdot40/160\cdot146/34$$

$$n_{P/K}=2069\ \text{min}^{-1}.$$

Figure 4:
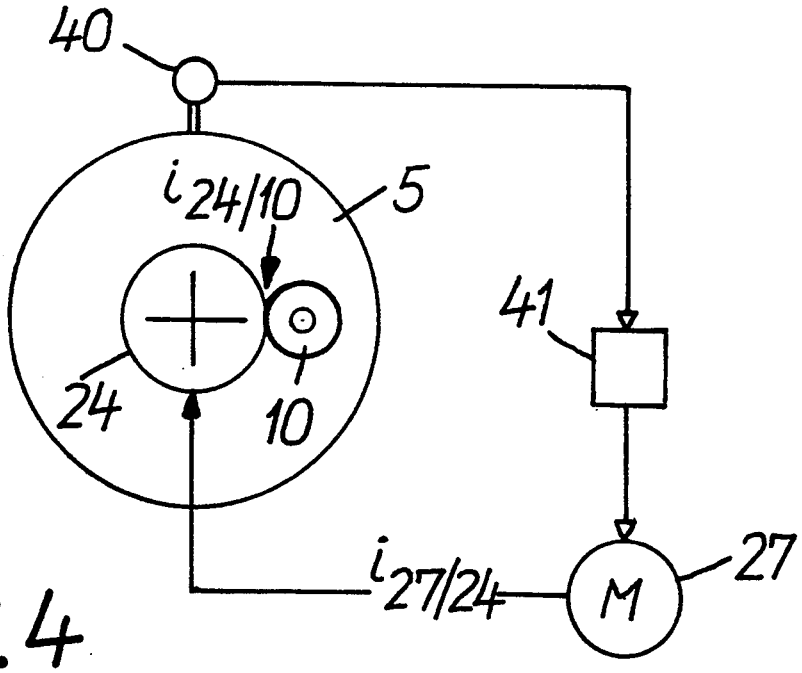
FIG. 4 is a schematic illustration of a different linkage of the sleeve shafts, turret head and auxiliary drive motor.

The present invention is not limited to the use of a differential gear. For example, turret head 5 may be coupled mechanically, as indicated in FIG. 4, with a tachogenerator 40 as the revolution generator. Auxiliary motor 27 is connected with tachogenerator 40 by way of a preferably electronic adjustment device 41. The rate of rotation $n_{P/K}$ of sleeve shafts 8 with reference to turret head 5 is—as before—

$$n_{P/K}=i_{24/10}(n_{24}+n_K)$$

In order to keep the rate of rotation $n_{P/K}$ constant even if the rotational rate $n_K$ of turret head 5 changes, adjustment device 41 merely needs to put out a signal which produces the rotational rate $n_{27}$ in auxiliary motor 27 according to the following equation:

$$n_{27}=\frac{\frac{n_{P/K}}{i_{24/10}}-n_K}{i_{27/24}}$$

where $i_{27/24}$ is a fixed transmission ratio from auxiliary drive motor 27 to ring of teeth 24. The signal from adjustment device 41 includes only one variable—the rate of rotation $n_K$ of turret head 5—and is otherwise composed of constant values that can be put in.

Figure 5:
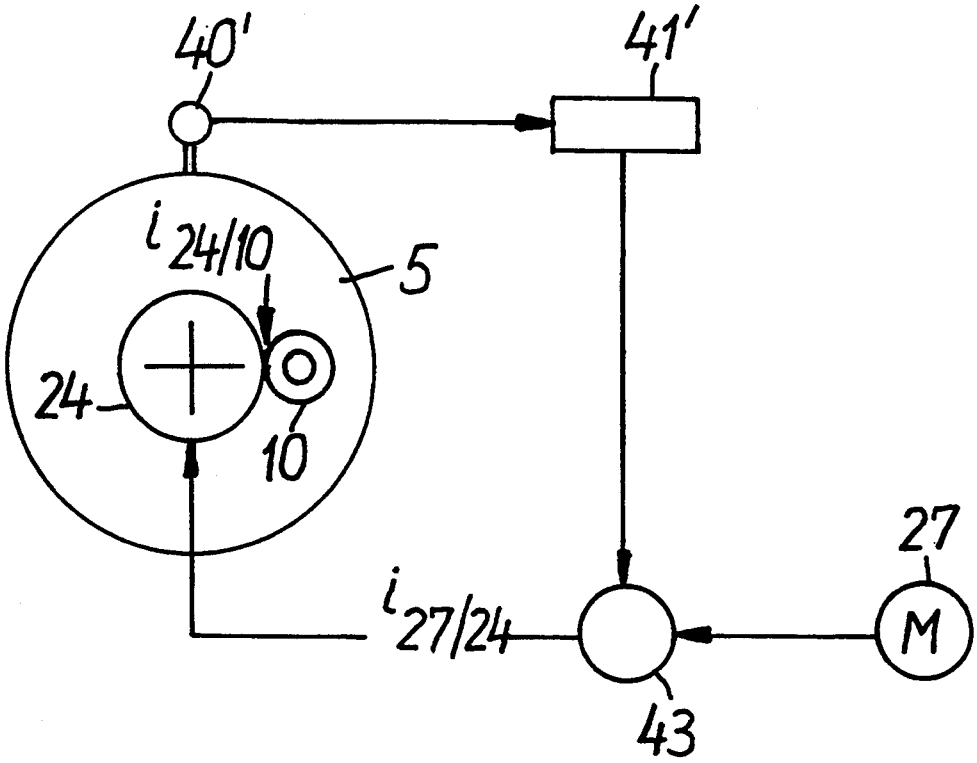
FIG. 5 is a schematic illustration of a different linkage of the sleeve shafts, turret head, adjustment gear and auxiliary drive motor.

It is also conceivable to keep the rate of rotation $n_{27}$ of auxiliary drive motor 27 constant and change the transmission ratio $i_{27/24}$ correspondingly by means of a variable transmission 43 as a function of the rate of rotation $n_K$ of turret head 5. For example, turret head 5 may be coupled mechanically, as indicated in FIG. 5, with a tachogenerator 40 as the revolution generator. Variable transmission 43 is connected with tachogenerator 40 by way of a preferably electronic adjustment device 41'. The rate of rotation $n_{P/K}$ of sleeve shafts 8 with reference to turret head 5 is—as before—

$$n_{P/K}=i_{24/10}(n_{24}+n_K)$$

In order to keep the rate of rotation $n_{P/K}$ constant even if the rotational rate $n_K$ of turret head 5 changes, adjustment device 41' merely needs to put out a signal which adjusts the gear ratio $i_{27/24}$ of variable transmission 43 according to the following equation:

$$i_{27/24}=\frac{\frac{n_{P/K}}{i_{24/10}}-n_K}{n_{27}}$$

where $i_{27/24}$ is a variable transmission ratio from auxiliary drive motor 27 to ring of teeth 24. The signal from adjustment device 41' includes only one variable—the rate of rotation $n_K$ of turret head 5—and is otherwise composed of constant values that can be put in.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A drive arrangement for a machine for applying sealant to lids including: a turret head rotatable about a vertical axis; a main drive motor coupled for driving the turret head for rotation about the vertical axis; a ring of teeth mounted for rotation about the vertical axis and relative to the turret head; a plurality of sleeve shafts carrying plates for the accommodation of lids, with the sleeve shafts being mounted for rotation about axes that are parallel to the vertical axis, each sleeve shaft including a pinion that is in engagement with the ring of teeth; the improvement comprising:

an auxiliary drive motor which is independent of said main drive motor and connection means for connecting said auxiliary drive motor with said ring of teeth for driving said pinions by way of said ring of teeth, said connection means for causing the rate of rotation of said ring of teeth to increase or decrease with a respective proportional decrease or increase of the rate of rotation of said turret head so that the sleeve shafts rotate continuously at a constant speed which is determined exclusively by said auxiliary drive motor and which is independent of the rate of rotation of said turret head caused by said main drive motor.

2. A drive arrangement as defined in claim 1, wherein said connection means includes a differential gear having a rotating housing that is driven by said auxiliary drive motor, one driven shaft and another driven shaft connected in a torque transmitting manner with said ring of teeth and said main drive motor, respectively.

3. A drive arrangement as defined in claim 2, wherein said one driven shaft of the differential gear is connected with said main drive motor by way of said turret head, there being a transmission ratio from said one driven shaft to said turret head which is of the same magnitude as a transmission ratio from said other driven shaft of the differential gear to said ring of teeth.

4. A drive arrangement as defined in claim 1, wherein said connection means has a fixed transmission ratio for driving said ring of teeth by said auxiliary drive motor and said drive arrangement further comprises an adjustment means for adjusting the rate of rotation of said auxiliary drive motor as as a function of the rate of rotation of said turret head.

5. A drive arrangement as defined in claim 1, wherein said connection means comprises a gear assembly having a variable transmission ratio which varies as a function of the rate of rotation of said turret head.

* * * * *